US005791912A

United States Patent [19]

Riechelmann et al.

[11] Patent Number: 5,791,912

[45] Date of Patent: Aug. 11, 1998

[54] CONTACTOR WITH MULTIPLE REDUNDANT CONNECTING PATHS

[76] Inventors: Bernd Riechelmann; Raymond Twigg, both of 9920 Scripps Lake Dr., #108, San Diego, Calif. 92131

[21] Appl. No.: 565,867

[22] Filed: Dec. 1, 1995

[51] Int. Cl.[6] ..... H01R 9/09

[52] U.S. Cl. ..... 439/66

[58] Field of Search ..... 439/66, 74, 70, 439/73, 91

[56] References Cited

U.S. PATENT DOCUMENTS

| | | | |
|---|---|---|---|
| 4,344,662 | 8/1982 | Dalamangas et al. | 439/91 |
| 4,402,562 | 9/1983 | Sado | 439/91 |
| 4,506,215 | 3/1985 | Coughlin . | |
| 5,069,629 | 12/1991 | Johnson . | |
| 5,207,584 | 5/1993 | Johnson . | |
| 5,385,477 | 1/1995 | Vaynkof et al. . | |
| 5,403,194 | 4/1995 | Yamazaki . | |

OTHER PUBLICATIONS

One page specification sheet for Zebra connectors.

*Primary Examiner*—Gary F. Paumen
*Assistant Examiner*—Christopher Goins
*Attorney, Agent, or Firm*—Thomas J. Tighe

[57] ABSTRACT

A contact array includes: (1) a plurality of uniform columns each for providing electrical continuity between things respectively in contact with opposite ends of the columns, each column means having a memory urging it to be straight, and (2) an elastomeric carrier, reinforced with a polymer, to which all the columns are affixed, for holding them parallel to each other, spaced apart, aligned along an axis normal to them, and preferably symmetrical with respect to the axis. The carrier also forces the columns to be uniformly arcuate along the axis. The opposite ends of the columns define respective opposite contact margins of the array. A housing defines a chamber for containing the array. Two opposite walls of the chamber define respective openings through which the contact margins protrude for accepting compressive contact forces that are applied during operation. The chamber further includes space to allow further, unobstructed, resilient arcuation of all the columns whenever the contact force is applied to the margins. Each column can include a plurality of bundled, elongated leaves of conductive material, each leaf having a memory urging it to be straight. The array can be moveable back and forth, over a range, in the directions that the forces are applied to the contact margins to equalize the forces. Several novel methods for manufacturing the contactors are also described.

15 Claims, 6 Drawing Sheets

CONTACTOR WITH MULTIPLE REDUNDANT CONNECTING PATHS

BACKGROUND OF THE INVENTION

This invention relates in general to solderless electrical contacts, and in particular to such contacts using a resilient conductive column that is made to buckle when contact is made, commonly called "buckling column" contacts.

Electrical contact reliability, particularly the prevention of continuity failure, becomes ever more important as contacts are both miniaturized and the number of leads per assembly increases. This invention addresses the problem of obtaining improved continuity by providing a plurality of parallel connecting paths for each separate lead of a connector assembly having a plurality of such leads. Therefore, the temporary or permanent failure of any one or more of the paths will not create a discontinuity and impair the performance of the entire connector as long as the number of failed paths per lead is less than the total number of connecting paths.

Additionally, this invention can reduce the contact resistance per lead in cases where the mating contact surface has high resistance due to contamination.

Additionally, this invention reduces contact inductance and contact capacitance to facilitate the efficient conduction of high frequency signals without distortion.

Other advantages and attributes of this invention will be readily discernable upon a reading of the text hereinafter.

SUMMARY OF THE INVENTION

An object of this invention is to provide a contact array having connection reliability by including a plurality of redundant connecting paths to ensure reliable connection even if some individual paths fail.

A further object of this invention is to provide a contact array having reduced contact resistance by including a plurality of parallel contact paths.

A further object of this invention is to provide a contact column having a plurality of contacts with ends having sharp corners which cut through surface contamination.

A further object of this invention is to provide a contact array having multiple columns of redundant parallel contacts which are trimmed to different lengths so that each contact can flex and adapt to local surface irregularities independent of its neighbor.

A further object of this invention is to provide a contact array having a buckling column contact consisting of a plurality of hardened, flat metal leaves fixed in position by means of an encapsulating elastomer.

A further object of this invention is to provide a contact array having a buckling column contact consisting of a plurality of hardened round wires fixed in position by means of an elastomer.

A further object of this invention is to provide a contact column having a plurality of parallel redundant contacts the ends of which fan out upon actuation, thereby providing contact "wipe" to improve continuity.

A further object of this invention is to provide a contact array including a plurality of contact columns held in place by an elastomer that is reinforced with a dimensionally stable polymer, molded such that the contact array is retained in its housing while permitting some movement to equalize contacting forces applied against opposite contact margins.

A further object of this invention is to provide a contact array including a multi-lead connector, each lead having a plurality of parallel redundant contacts which are compressible, and which connect two circuit panels, or connect an integrated circuit to a panel.

A further object is to provide a contact column including contact tips that are curved to concentrate contact force to a point.

A further object of this invention is to provide a contact array as described above with multiple redundant elements used for establishing solderless connections to an integrated circuit, for the purpose of burn-in, testing, or temporary or permanent installation.

A further object is to provide a contact array including a contact assembly in which the contacts due to their high redundancy, operate reliably even under very light pressure, so that unsupported integrated circuit leads can be contacted without deforming said leads.

A further object is to provide a contact array as described above in which the individual contact elements are fabricated from a hardened, high conductivity alloy such as beryllium copper, rhodium, beryllium nickel, Paliney-7 or carbon steel and the like.

A further object is to provide a contact array as described above in which the alloy is coated with a reactive metal or polymer to improve adhesion of the elastomer.

A further object of this invention is to provide a contact array as described above in which the bulk of elastomer is minimized so that the incidental stiffness of the elastomer does not interfere with the flexing of the contact elements.

A further object of this invention is to provide a contact array as described above in which the elements are made of an alloy which, although having high bulk resistance, may have other desirable properties, such as extreme hardness or corrosion resistance, and despite the high resistance of individual elements, a low overall resistance is still obtained due to the plurality of parallel paths.

A further object of this invention is to provide a contact array as described above in which the individual columns are not interleaved with non-conducting spaces, but where the entire length of the strip is filled with parallel conducting elements closely packed. Such an arrangement giving a universal, pitch independent connecting strip. In said design, longitudinal alignment of the contact strip relative to the contacts becomes unnecessary.

A further object of this invention is to provide a contact array as described above in which the individual elements are insulated from each other by a surface coating, such as employed for magnet wires.

A further object of this invention is to provide a contact array as described above in which such a connecting strip is used to connect to very tightly spaced points, such as encountered on integrated circuit wafers or flat panel displays.

A further object of this invention is to provide compressible connecting contacts with reduced lead inductance and lead-to-lead capacitance, hereinafter referred to as contact impedance. Advanced circuits, operating at higher frequencies, require said reduced contact impedance. Said reduction in impedance is achieved by reducing the length of said connecting contacts. A given contact, however, can not be arbitrarily shortened without loosing compressibility. The present invention provides a means of achieving compressibility in contacts of reduced length by dividing each contact into a plurality of thinner, more flexible elements.

These objects, and other objects expressed or implied in this document, are accomplished by an electrical contactor having a contact array that includes: (1) a plurality of uniform columns each for providing electrical continuity between things in contact with opposite ends of the columns, each column means having a memory urging it to be straight, and (2) an elastomeric carrier, to which all the columns are affixed, for holding them parallel to each other, spaced apart, aligned along an axis normal to them, and necessary with respect to the axis, the carrier also forcing all the columns to be uniformly arcuate along the axis, the opposite ends of all the columns defining respective opposite contact margins of the array. The contactor further includes a housing, defining a chamber, for containing the array. The chamber is at least partially defined by two opposite walls defining respective openings through which the contact margins protrude. The contact margins are exposed to accept the compressive forces that are applied to them during operation. The chamber further includes space to allow further, unobstructed, resilient arcuation of all the columns whenever the compressive force is applied to the margins. Preferably each column includes a plurality of elongated leaves of conductive material, each leaf having a memory urging it to be straight, and means for bundling the leaves together to form said each column means. Preferably the contactor also includes a means for equalizing the compressive contacting forces applied against the contact margins. In the preferred embodiment, the equalizer includes clearances, defined by the housing, for allowing the array to be moveable back and forth in a direction parallel to the column means, and means for limiting the range of array movement. Also described herein are several novel methods for manufacturing a contactor according to this invention.

DESCRIPTION OF THE PREFERRED EMBODIMENT

Referring to FIGS. 1–6, a plurality of contact columns 2 are illustrated to each include a plurality of electrically conductive, elongated slat-like leaves 4. The leaves of a column are resilient, of uniform width and abut each other. The leaves each have a memory that urges them to be straight. As best illustrated in FIG. 4A, the columns are sandwiched between two sheets of polyimide, 3A and 3B, (such as KAPTON made by Dupont) and held in spaced, parallel relation to each other by elastomer spacers 5 which adhere to the polyimide sheets. The column sandwich is affixed to a rectangular face of an elastomer carrier 6, the carrier face adhering to the inner sheet of polyimide 3B. As illustrated the columns are affixed to the elastomer face such that they are parallel to each other, uniformly spaced apart, aligned along an axis (x-x) of the elastomer face, and normal to and symmetrical with respect to the axis. As will be explained, the columns are partially buckled so as to be uniformly arcuate. The column sandwich and its elastomer carrier form a unitary contact array, and the opposite ends of the columns define respective opposite contact margins, 7A and 7B, of the array.

Figure 1:
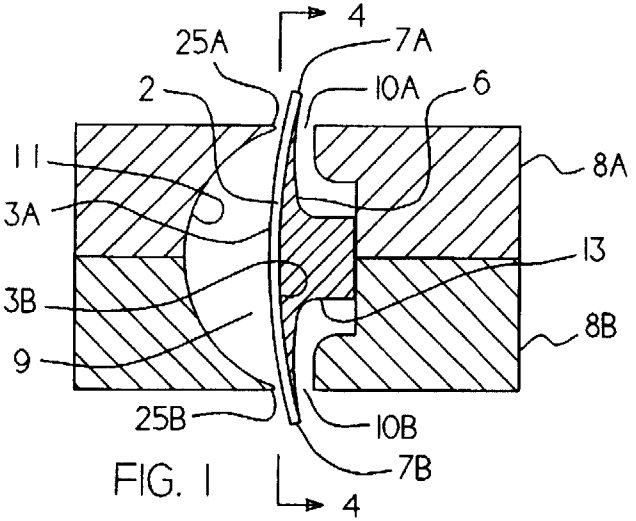
FIG. 1 is a lateral cross-sectional view of a contact assembly according to this invention.
Figure 2:
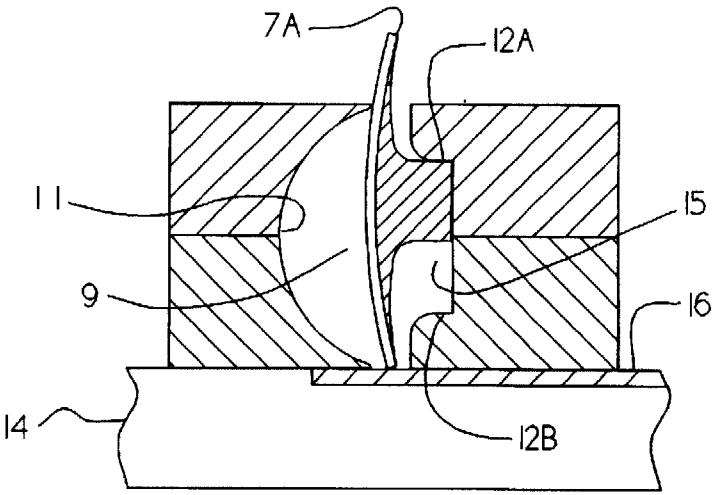
FIG. 2 is a partial lateral cross-sectional view of the contact assembly of FIG. 1 abutting a printed circuit board.
Figure 3:
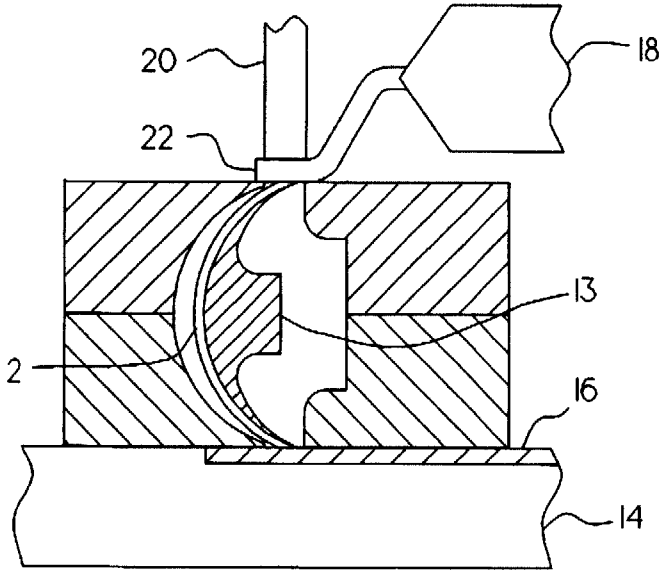
FIG. 3 is a lateral cross-sectional view of the contact assembly of FIG. 1 in operation providing electrical continuity between the lead of an integrated circuit and a conductive strip on a printed circuit board.

Referring to FIGS. 1–4 and 5, the contact array is contained in a chamber 9 defined by symmetrical halves, 8A and 8B, of a housing. Opposite walls of the chamber define respective openings, 10A and 10B, through which the contact margins, 7A and 7B, extend for exposing the column tips to electrical contact therewith. The chamber includes space opposite the carrier face, for example a barrel-like recess 11, for allowing further unobstructed, resilient arcuation, i.e. buckling, of the columns whenever compression forces act against the upper and lower margins of the array, as best illustrated in FIG. 3. The bulk of the elastomer carrier is preferably minimized to an extent that any inherent stiffness of the elastomer does not interfere with the flexing of the columns.

Referring again to FIGS. 1–6, protruding from a backside of the carrier (referenced to the outer face of the column sandwich) is an elongated ridge 13 normal to the columns. The chamber 9 further includes an open (to the chamber) slot 15 in which the ridge is disposed. The slot is wide enough to allow the ridge to travel a distance up and down limited only by the upper and lower sides, 12A and 12B, of the slot. Thus the contact array can likewise travel up and down (or back and forth depending on the orientation) to equalize the contacting forces applied against the array's margins. This is best illustrated in FIG. 2 in which a printed circuit panel 14 has pushed the carrier ridge 13 to its upper limit, and as further illustrated, the lower tip of a conductive column 2 is in physical contact with a conductive strip 16 on the circuit panel.

As used herein, the terms "up", "down", "upper" and "lower" are not meant to imply any necessary or absolute orientation of this invention, but rather are merely reference terms related only to the orientation of the invention as depicted in the drawings. This invention can in fact be used in any orientation.

FIG. 3 illustrates an integrated circuit 18 and a pushing device 20 applying contact force directly to leads 22 of the integrated circuit, thereby avoiding lead bending. The leads in turn apply compressive force to the columns of the contact array thereby further buckling the array.

In the preferred embodiment, due to the memory in the constituent leaves, the conductive columns each have a memory urging them to be straight, but they are forced to be uniformly arcuate even in the absence of any compressive force. This initial curvature is to ensure that all columns will buckle in the same direction when compressed as, for example, in FIG. 3. If they were straight and not uniformly curved in the same direction, they would tend to buckle at random, in mutually opposing directions. They would interfere with each other's orderly buckling, leading to damage by crushing. Depending on the method of manufacture chosen, the slight initial curvature can be obtained in at least three ways. In one way the elastomer face to which the column sandwich is affixed is uniformly convex along the x-x axis, and the elastomer forces the columns to conform to the face. FIGS. 1–4 illustrate this case.

In a second way (not shown) the columns are straight until the array is inserted into the chamber 9. Once inserted, the array is squeezed between the base of the chamber slot 15 and the forward edges, 25A and 25B, of the array margin openings, 10A and 10B respectively, such that the columns are slightly bent. In other words, the base of the slot applies a force against the elastomer ridge 13 which is countered by an equal and opposite force applied against the face of the array by the openings' edges, 25A and 25B. When an external buckling force is applied, as in FIG. 3, ridge 13 recedes from the base of the slot 15 and the initial bending force that was applied by the edges, 25A and 25B, is replaced by the buckling force acting against the array margins, 7A and 7B.

In a third way, the column leaves themselves are each manufactured to have a memory which urges them to have a precise initial curvature.

Figure 4:
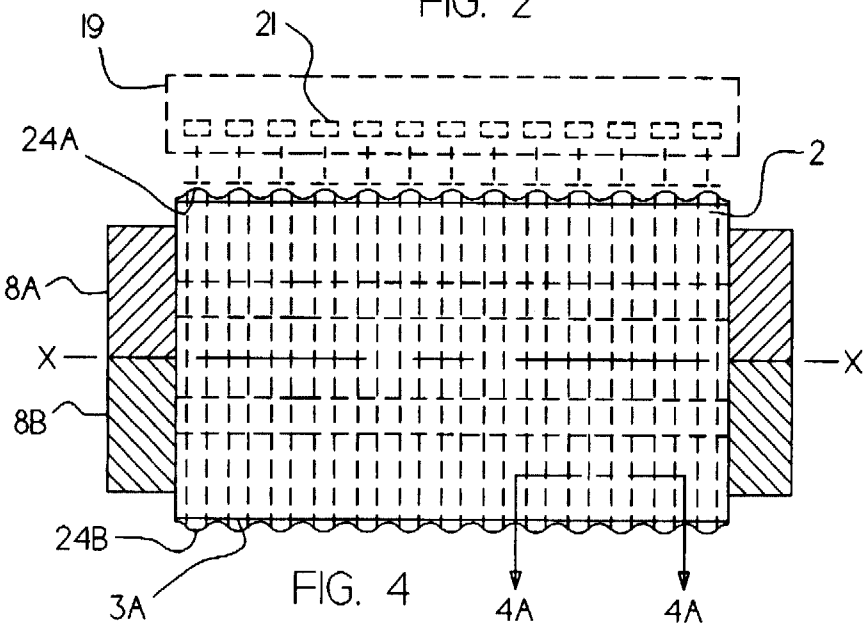
FIG. 4 is a cross-sectional view of the contact assembly of FIG. 1 taken along line 4—4.
Figure 4A:
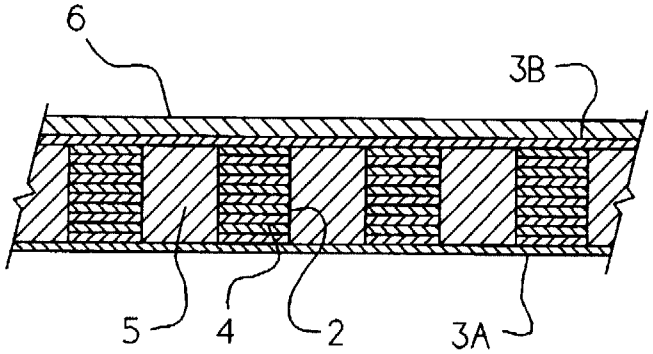
FIG. 4A is a cross-sectional view of the contact assembly of FIG. 4 taken along line 4A—4A.

Referring to FIGS. 4 and 4A, optionally the upper and lower tips, 24A and 24B, of the columns 2 may each be curved to have a zenith in the direction of operational contact in order to concentrate contact forces to respective points. In phantom above the column array is an integrated circuit (IC) 19 with leads 21 having a certain "pitch" (which refers to the distance between the centers of adjacent contact terminals of a set of uniformly spaced contact terminals). In this embodiment, the pitch of the contact columns 2 matches the pitch of the IC leads so that there will be perfect registration between the two, as indicated by the dashed lines.

Figure 6:
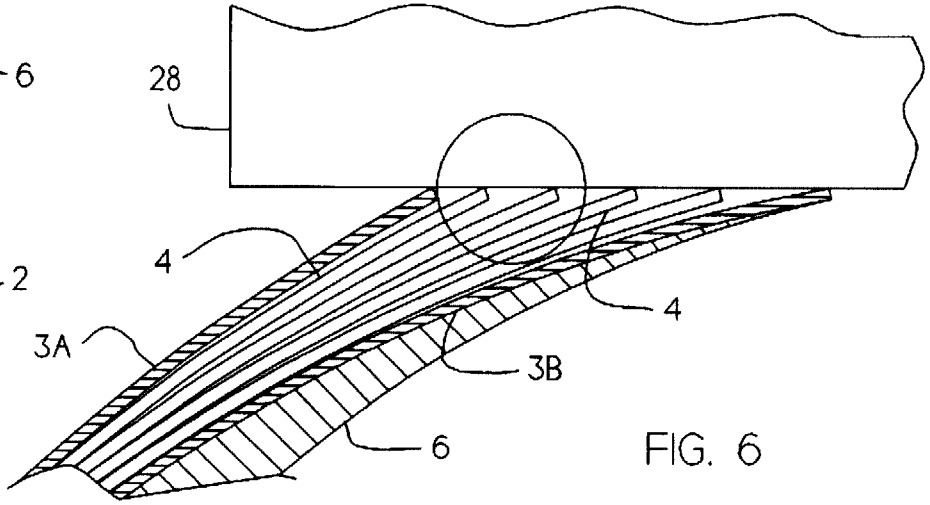
FIG. 6 is an enlarged view of the contact assembly abutting the lead of an integrated circuit as in FIG. 3.
Figure 6A:
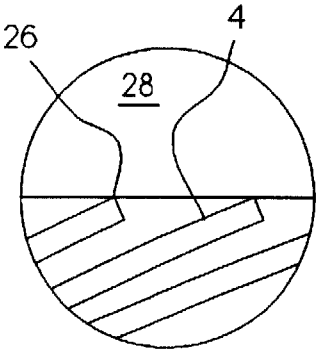
FIG. 6A is a detail view defined by the circle in FIG. 6.
Figure 5:
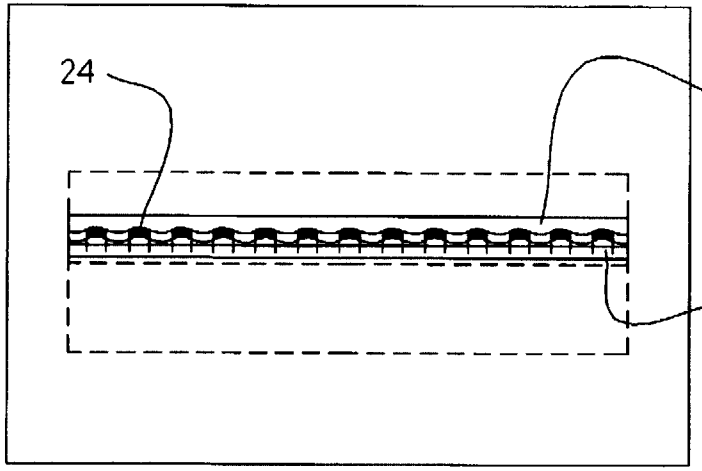
FIG. 5 is a plan view of the contact assembly of FIG. 1.

FIG. 6 best illustrates how each contact column actually consists of a bundle of parallel leaves 4 sandwiched between the two sheets, 3A and 3B, of polyimide. Elastomers have high rates of thermal expansion, whereas polyimide is a polymer that is dimensionally stable under extremes of temperature. Said sheets of polyimide therefore impart dimensional stability, thereby maintaining accurate pitch and contact alignment at temperature extremes. Although only four leaves are illustrated, it should be understood that many more, or fewer, leaves can be used without departing from the scope and objects of this invention. Preferably ten leaves are used to form a contact column. FIG. 6A best illustrates that the ends of leaves have sharp square corners 26 which can bite through any surface contamination of a conductor 28, and that in response to contact force, the column ends fan out to permit individual conformance to surface irregularities of the conductor, and to cause what is commonly known as the "scrub effect" which scrubs away surface oxidation and contaminants.

Figure 7:
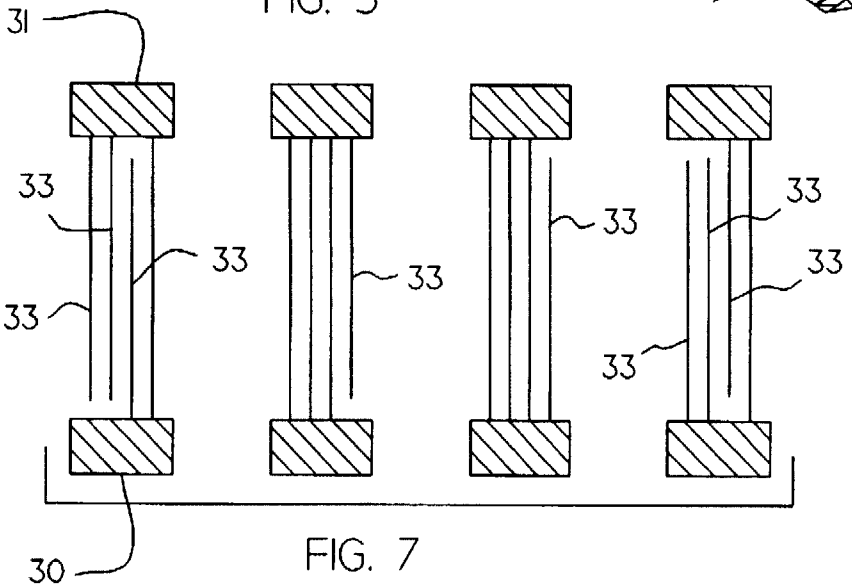
FIG. 7 is a schematic representation of the electrical continuity provided by this invention between opposing terminals.

FIG. 7 best illustrates the effect of the multiple, parallel redundant leaf contacts between individual terminals 30 and 31. Even though various leaves 33 have failed to make a connection, for example due to localized surface defects or permanent mechanical damage to them, continuity is nevertheless achieved because of the redundancy.

Figure 8:
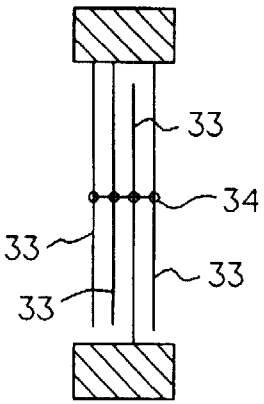
FIG. 8 is a view as in FIG. 7 but further illustrating optional interconnections.
Figure 21:
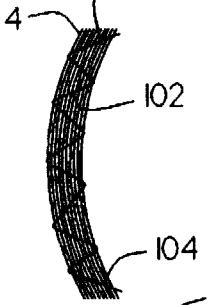
FIG. 21 is a side view of an overwrapped bundle of contact leaves.
Figure 22:
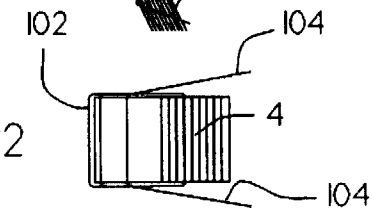
FIG. 22 is an enlarged end view of the overwrapped bundle of FIG. 21.

FIG. 8 best illustrates additional connection reliability that is obtained by optionally interconnecting contact leaves at a midpoint 34 as by local welding or other means. Also, the conductive leaves 4 can be overwrapped with a wire or string 102, as illustrated in FIGS. 21 and 22. overwrapping ties the conductive contact elements into a bundle so that they are in contact with each other at all times. At the same time the wrapping element is kept loose enough so that individual elements can slide relative to each other, as is necessary to permit buckling. The ends 104 of the wrapping element are permitted to partially unwind so that fan-out, as shown in FIGS. 6 and 6A, can occur. A further advantage of overwrapping is ease of handling and savings in labor. For example, a preferred column bundle consists of ten individual leaves, each 1/1000 of an inch thick by 1/100 of an inch wide. Being so small they are difficult to handle individually, but bundles of same are not so problematic.

Figure 9:
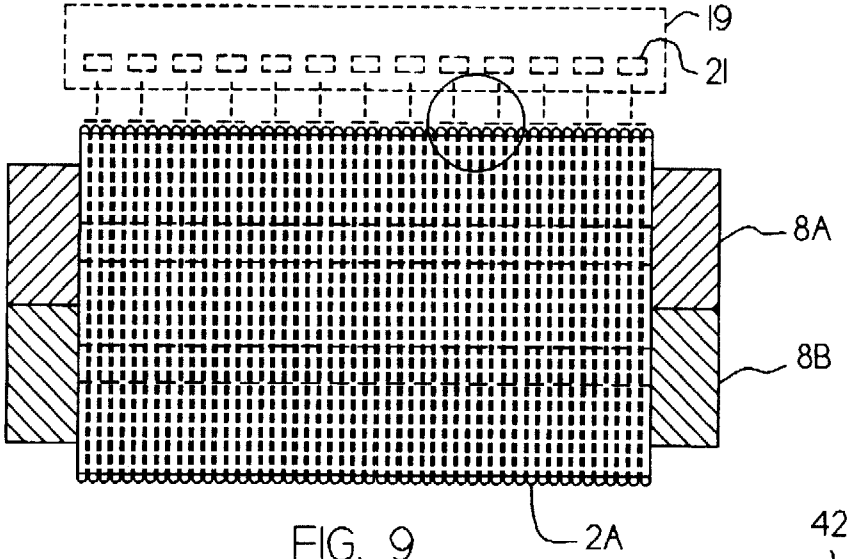
FIG. 9 is a cross-sectional view of a second embodiment of a contact assembly, according to this invention, taken along 4—4 of FIG. 1.
Figure 9A:
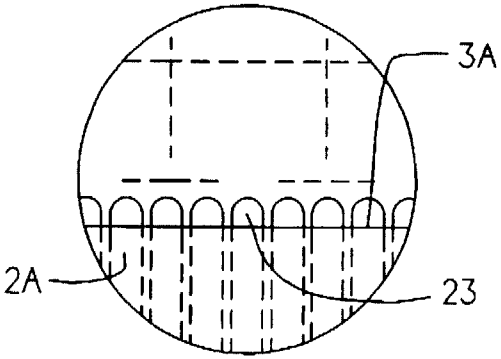
FIG. 9A is a detail view defined by the circle of FIG. 9.

Referring to FIGS. 9 and 9A, illustrated is an embodiment of a contactor which is independent of the pitch of the intended contact terminals. The intended contact terminals in this illustration are IC leads 21, and since the contact array has many more columns 2A (each consisting of a plurality of sandwiched, bundled leaves as described above) than there are IC leads, there will always be at least one column available to contact each lead, while idle columns 23 serve as nonconducting spacers. In this embodiment the width of the columns' contact tips must be less than the minimum space between the contact terminals of a device to be contacted. This design variation has two very significant advantages:

1. A given contactor can serve a plurality of differently spaced terminals. Therefore, it is pitch independent or universal.

2. Precise alignment between the columns of the contact array and mating terminals is unnecessary.

Certain preferred raw materials are used to manufacture the contact array (items 2 and 6 of FIG. 1). The contact columns 2 are preferably made from a metal foil or ribbon made of a material which has good electrical conductivity and good mechanical spring properties. One such material is beryllium copper. The elastomer carriers are preferably made from an elastomer in its un-vulcanized liquid state which after polymerization will form an elastomer and which also bonds to the polyimide sheets confining the contact columns. One such material is Dow Corning silicone rubber compound Sylgard-186 (which is translucent, facilitating visual inspection of the completed assembly as well).

The contact array is manufactured primarily in three steps. The first step is preparation of a mold assembly which can be done using any one of four methods: Method A, method B, method C-1 or method C-2. Method A includes cutting a plurality of contact patterns into each of a plurality of foils by means of etching or stamping. Method B includes cutting a plurality of contact patterns simultaneously into a plurality of foil layers which are wrapped onto a mandrel. Cutting is done typically by the wire of an electrical discharge machining process (EDM). Method C includes winding a plurality of piggyback layers of ribbon foil onto a mandrel where the turns are spaced to equal the contact spacing desired. Method C-2 includes steps the same as method C-1 except that the turns are spaced as closely as possible without actually touching.

Figure 10:
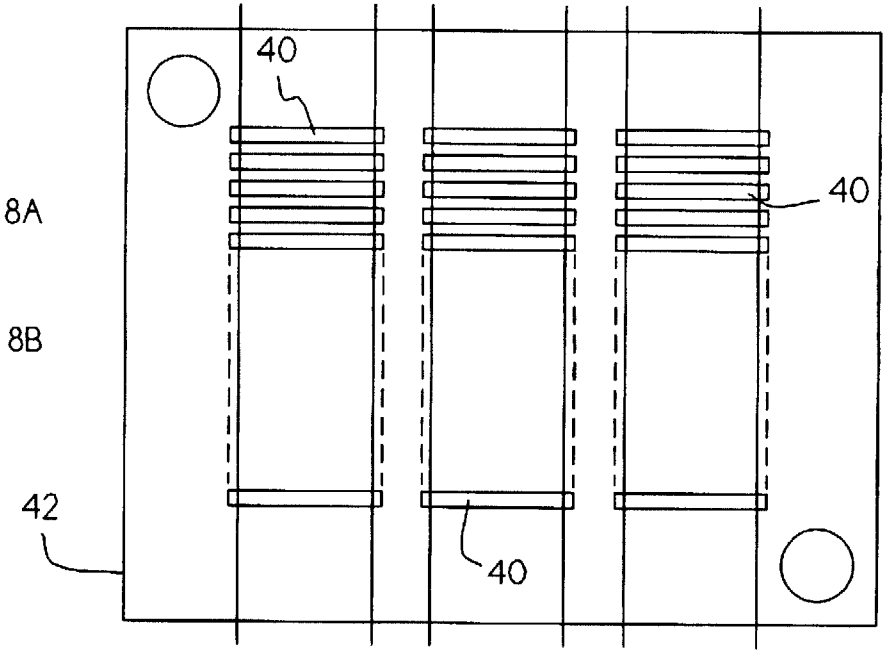
FIG. 10 is a plan view of a foil of contact metal being processed to make contact leaves according to a first manufacturing process of this invention.
Figure 11:
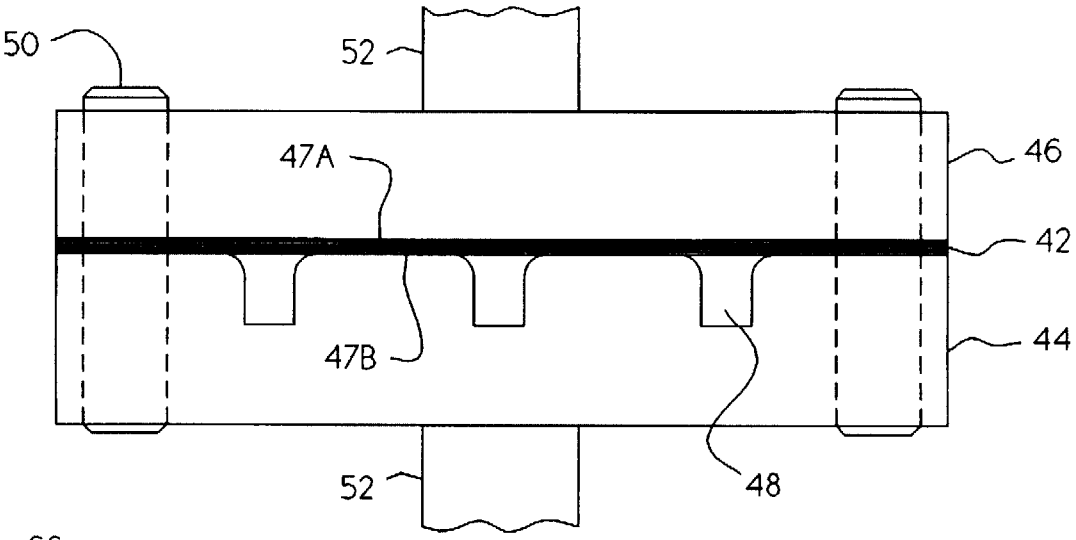
FIG. 11 is a side view of a plurality of stacked metal foils, as in FIG. 10, clamped between mold plates.

Referring to FIGS. 10 and 11 for method A, a plurality of openings 40 are etched into a rectangular sheet of metal foil 42. Then the metal foil is treated with a primer, such as Dow Corning #1200 to improve adhesion of the elastomer. Next a plurality of foils, typically ten or more, are stacked and clamped between mold plates 44 and 46 of FIG. 11. The stack of metal foils is sandwiched between a first and last layer of polyimide film, 47A and 47B. Mold plate 44 has grooves 48 for the injection of elastomer resin and to form the ridge 13 that engages travel stops 12A and 12B (FIG. 2). The mold plates and foils are aligned by pins 50 and clamped by clamping mechanism 52. The mold assembly is then ready for molding.

Figure 13:
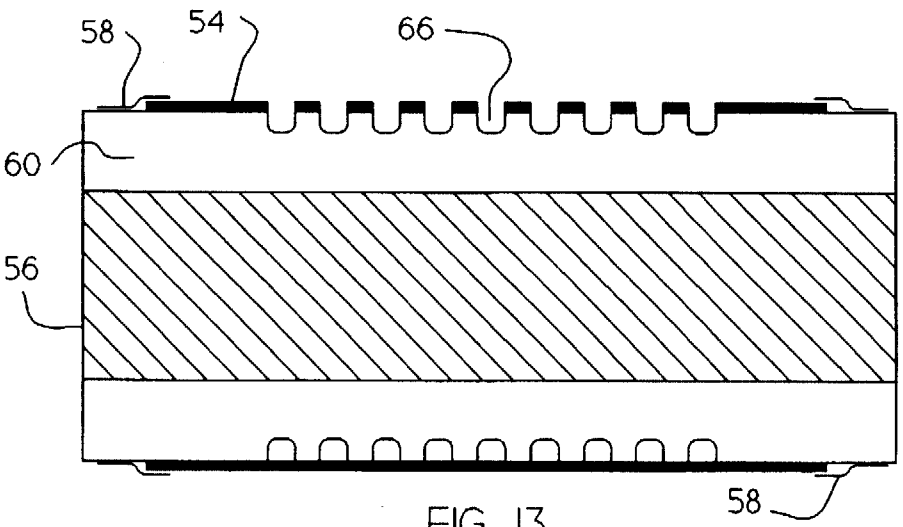
FIG. 13 is a longitudinal cross-sectional view of the mandrel of FIG. 12.
Figure 12:
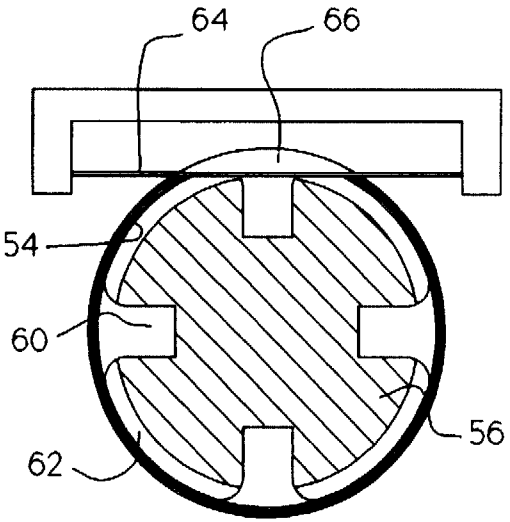
FIG. 12 is a lateral cross-sectional view of a mandrel wrapped with multiple layers of contact foil according to a second manufacturing process.

Referring to FIGS. 12 and 13 for method B, a plurality of layers (typically ten or more) of foil 54 are obtained by wrapping them around a mandrel 56 and securing them with adhesive tape 58. Before wrapping, the surface of said foil may optionally be coated with a dry lubricant such as molybdenum disulfide, to facilitate relative movement of contact elements in applications which are subject to high cyclic use. The mandrel has grooves 60 which serve to form the elastomer carrier ridges as described in method A. The mandrel also has clearance grooves 62 for a traveling EDM (electrical discharge machining) cutting wire 64. The mandrel is preferably made of a material that will not cause adhesion of the elastomer despite being coated with primer. Examples of such materials are TEFLON and NYLATRON.

After all cuts 66 are completed, the mandrel and foil wrap assembly are treated with a primer to promote adhesion of the elastomer to the edges of every layer of foil. After applying an outer wrap of polyimide film (not shown), the mandrel assembly is now ready for molding.

Figure 15:
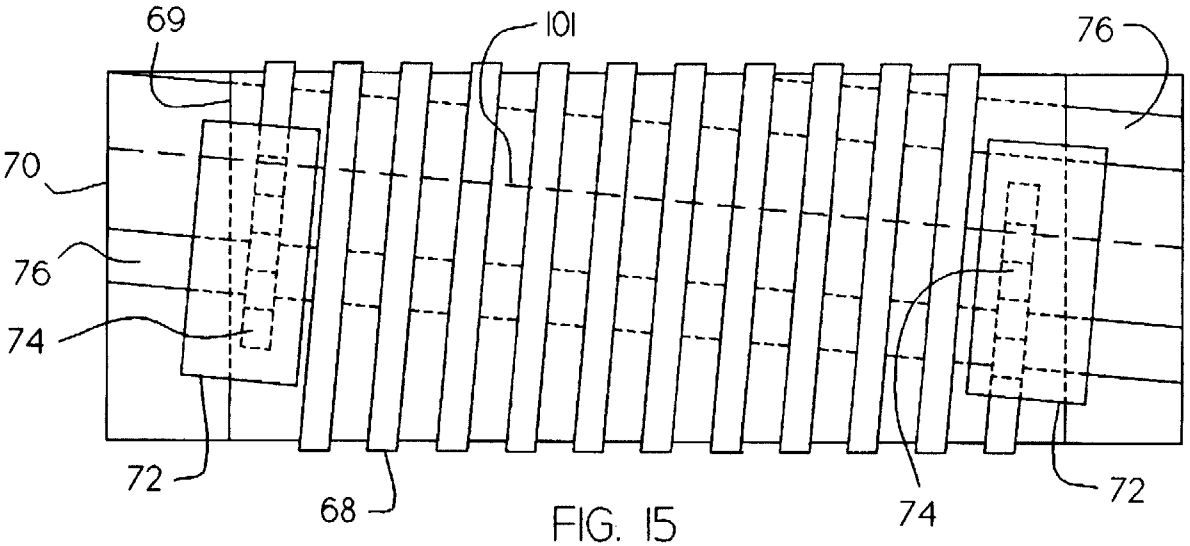
FIG. 15 is a side view of the wrapped mandrel of FIG. 14.
Figure 14:
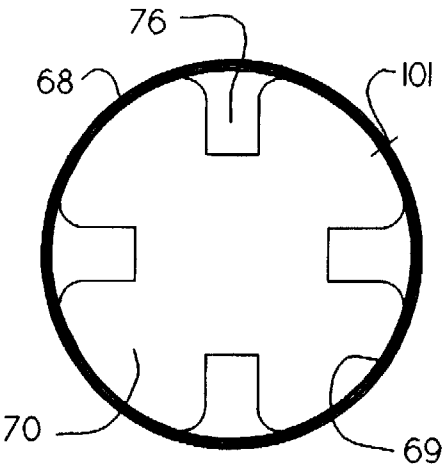
FIG. 14 is an end view of a mandrel helically wrapped with multiple layers of ribbon-cut metal foil according to a third manufacturing process.

Referring to FIGS. 14 and 15 for method C-1, this method avoids the need for foil cutting by using ribbon foil 68 with a width equal to the contact width desired. After wrapping a single layer of polyimide film 69 around the mandrel, a plurality of layers of ribbon foil, previously treated with primer, are wrapped piggyback in multiple layers around mandrel 70 in helical fashion. Adhesive patches 72 secure the ends of each layer 74. Injection and retention grooves 76 analogous to item 60 of FIG. 12 are at right angles to the wraps of foil ribbon. The mandrel is now ready for molding.

Figure 17:
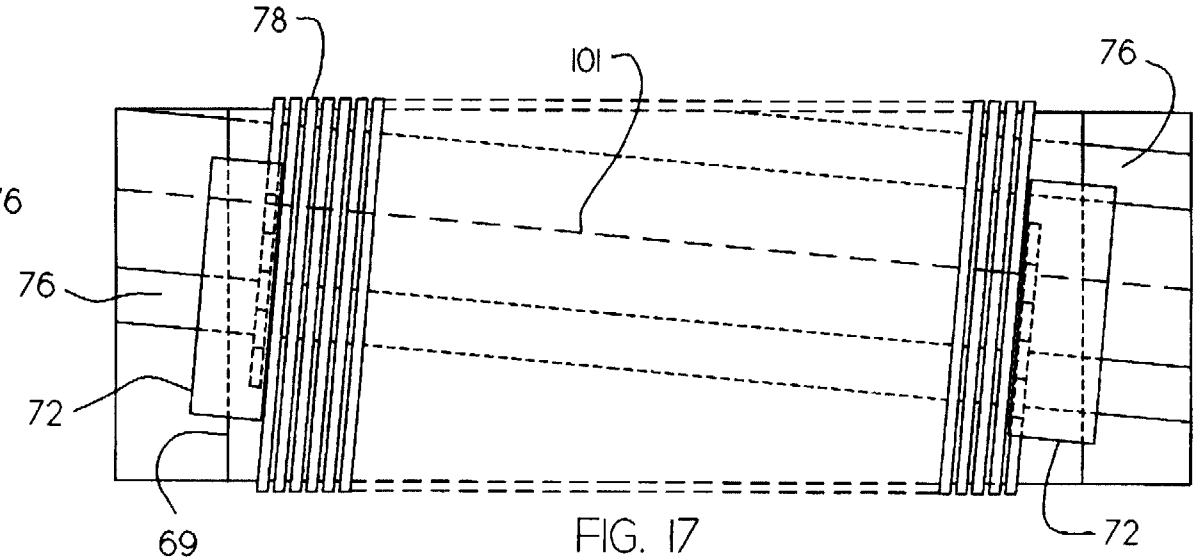
FIG. 17 is a side view of the mandrel of FIG. 16.
Figure 16:
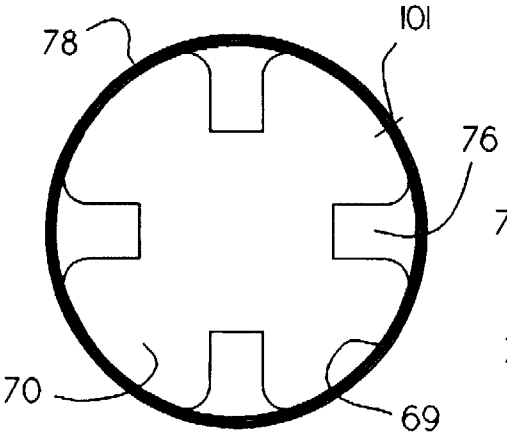
FIG. 16 is a mandrel wrapped with multiple layers of ribbon-cut metal foil according to a fourth manufacturing process.

Referring to FIGS. 16 and 17 for method C-2, this variation is similar to method C-1 except that the turns 78 of the ribbon foil wrap are spaced as closely as possible without actually touching. This method is used to make lead pitch independent contact arrays as illustrated in FIGS. 9 and 9A.

Yet another method, not illustrated, replaces the ribbon foil of method C-2 with fine round wire, closely wound with turns actually touching. Each wire is insulated from its neighbors by means of magnet wire varnish. Impregnation with elastomer is applied as before. This method is useful when contacting very closely spaced terminals such as encountered on integrated circuit wafers and flat panel displays. Flat panel displays commonly employ connecting strips consisting of interleaved conducting and nonconducting elastomers. Such strips are known as "zebra strips." A very important advantage of the present invention is that the metal contacts do not suffer from the high resistance of the conductive elastomers used in zebra strips.

In all the above methods, the polyimide film is preferably primed with Dow Corning #1205 primer to promote adhesion of silicone rubber. To further promote adhesion, the polyimide film may be coated with a thin film of a metal oxide, such as $SiO_2$ or $Al_2O_{31}$ prior to priming.

Figure 19:
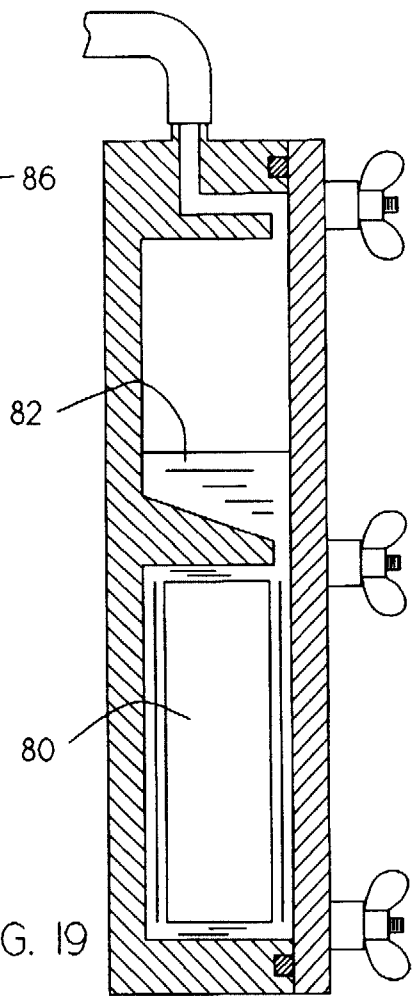
FIGS. 18 and 19 are each partial cross-sectional views which together illustrate a process for vacuum impregnating molds prepared according to the first through fourth manufacturing processes.
Figure 18:
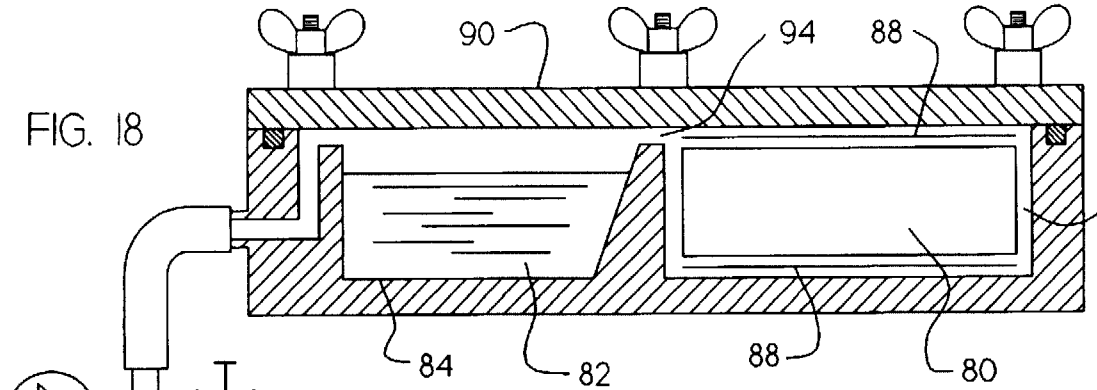

The next step in the manufacturing process is the molding. Referring to FIGS. 18 and 19, a mold assembly 80 prepared by methods A, B, C-1 or C-2 above is impregnated in the illustrated apparatus. Elastomer resin 82 blended with catalyst is poured into a reservoir 84 inside a chamber 86. The mold assembly is placed in the chamber outside the reservoir. If the mold assembly is of the mandrel type (methods B, C-1 or C-2) the foil on the mandrel is first covered by a mold releasing film 88 to define the outer surface of elastomer coverage and mold release. Then the chamber is sealed with transparent cover 90 and evacuated with vacuum pump 92. After outgassing of the mold assembly 80 and resin 82, the chamber is turned vertical as in FIG. 19. The resin will then engulf the mold assembly through a passage 94. At this point the pump is stopped and a valve 96 is opened to admit atmospheric pressure which exerts force on the resin forcing it to impregnate the mold assembly. After the resin has cured into an elastomer, the mold assembly is removed from the chamber and the molding, consisting of elastomer carriers and contact columns is removed from the mold plates by releasing the clamping mechanism of FIG. 11, or is removed from a mandrel by a lengthwise incision 101 as in FIGS. 14, 15, 16, or 17.

Figure 20:
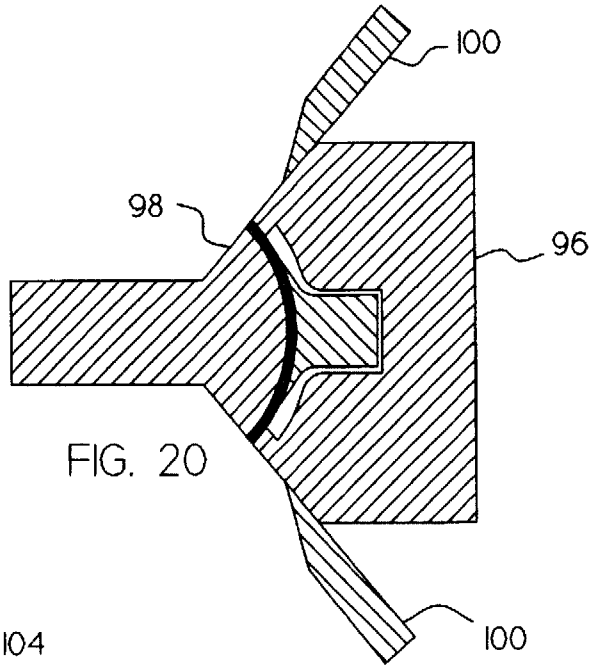
FIG. 20 is a cross-sectional view of a tool for trimming the ends of contact leaves according to this invention.

As a final step, the individual ends of the contact columns are progressively trimmed to different lengths using a tool such as illustrated in FIG. 20. This is done to allow the leaves to flex and adapt to local contact surface irregularities independently of their neighbors. An untrimmed contact array (consisting of a plurality of contact columns and their elastomer carrier) is clamped between dies 96 and 98. This flexes the columns in reverse causing their ends to align in proper relationship to permit simultaneous trimming by cutting instruments 100. Cutting instruments may be a knife as shown, or milling cutter, or an abrasive wheel, or a high pressure abrasive water jet. optionally, a cutting instrument may be formed to produce special tip shapes such as items 24A and 24B in FIG. 4. When correctly trimmed, the ends of the individual contact leaves will fan out under pressure as illustrated in FIG. 6.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

We claim:

1. An electrical contactor comprising:

(a) a contact array comprising:

(1) a plurality of uniform column means each for providing electrical continuity between things in contact with opposite ends of said each column means, (2) each column means comprising a plurality of elongated leaves of conductive material, each leaf having a memory urging it to be straight, and means for bundling the leaves together to form said each column means, (3) an elastomeric carrier means, to which all the column means are affixed, for holding them parallel to each other, spaced apart, aligned along an axis normal to them, and symmetrical with respect to the axis, the carrier means also forcing all the column means to be uniformly arcuate along the axis, the opposite ends of all the column means defining respective opposite contact margins of the array, (b) housing means, defining a chamber, for containing the array, (c) the chamber being at least partially defined by two opposite walls defining respective openings through which the contact margins protrude, the contact margins being exposed to accept compressive contact forces applied to them, and (d) the chamber further including space to allow further, unobstructed, resilient arcuation of all the column means whenever a compressive force is applied to the contact margins.

2. The contactor according to claim 1 wherein the ends of the elongated leaves have sharp corners for cutting through surface contamination.

3. The contactor according to claim 1 wherein the ends of the elongated leaves are progressively trimmed to different lengths so that each can independently flex and adapt to local contact surface irregularities.

4. The contactor according to claim 1 wherein the ends of the elongated leaves fan out in response to compressive force.

5. The contactor according to claim 1 wherein the ends of the elongated leaves are each curved to have a zenith in the direction of operational contact in order to concentrate contact force to a point.

6. The contactor according to claim 1 wherein the elongated leaves are fabricated from a hardened, high conductivity alloy.

7. The contactor according to claim 1 wherein the contact leaves are coated with a substance to improve adhesion to the elastomeric material of the carrier means.

8. The contactor according to claim 1 wherein the elastomeric carrier means is minimized to an extent that any inherent stiffness of the elastomer does not interfere with the arcuation of the column means.

9. The contactor according to claim 1 wherein all the column means are sandwiched between two sheets of polymer and one of the polymer sheets is affixed to the elastomeric carrier, and further comprising means for spacing the column means, said polymer sheets imparting pitch dimensional stability despite variations in temperature over an operational range.

10. The contactor according to claim 9 wherein the polymer is polyimide.

11. The contactor according to claim 1 wherein the width and spacing of the plurality of column means is such that the contactor can effectively mate with a plurality of contact terminal pitches.

12. The contactor according to claim 1 wherein the contact leaves are electrically interconnected.

13. The contactor according to claim 1 wherein the contact leaves are overwrapped.

14. An electrical contactor comprising:

(a) a contact array comprising:

(1) a plurality of uniform column means, each column means for providing electrical continuity between things in contact with opposite ends of said each column means, each column means having a memory urging it to be straight, (2) an elastomeric carrier means, to which all the column means are affixed, for holding them parallel to each other, spaced apart, aligned along an axis normal to them, and symmetrical with respect to the axis, the carrier means also forcing all the column means to be uniformly arcuate along the axis, the opposite ends of all the column means defining respective opposite contact margins of the array, (b) housing means, defining a chamber, for containing the array, (c) the chamber being at least partially defined by two opposite walls defining respective openings through which the contact margins protrude, the contact margins being exposed to accept compressive contact forces applied to them, (d) the chamber further including space to allow further, unobstructed, resilient arcuation of all the column means whenever a compressive force is applied to the contact margins, and (e) ridge means, connected to the array, for engaging a slot defined by the housing, the slot being large enough to allow the array to be moveable back and forth in a direction parallel to the column means.

15. An electrical contactor comprising:

(a) a contact array comprising:

(1) a plurality of uniform column means, each column means for providing electrical continuity between things in contact with opposite ends of said each column means, each column means having a memory urging it to be straight, (2) an elastomeric carrier means, to which all the column means are affixed, for holding them parallel to each other, spaced apart, aligned along an axis normal to them, and symmetrical with respect to the axis, the carrier means also forcing all the column means to be uniformly arcuate along the axis, the opposite ends of all the column means defining respective opposite contact margins of the array, (b) housing means, defining a chamber, for containing the array, (c) the chamber being at least partially defined by two opposite walls defining respective openings through which the contact margins protrude, the contact margins being exposed to accept compressive contact forces applied to them, (d) the chamber further including space to allow further, unobstructed, resilient arcuation of all the column means whenever a compressive force is applied to the contact margins, (e) clearance means, defined by the housing, for allowing the array to be moveable back and forth over a range between the openings through which the contact margins protrude, and (f) means for limiting the range of array movement comprising:

(1) a projection extending from the elastomeric carrier on a side of the elastomeric carrier opposite the column means and normal to the direction of array movement, and (2) a pair of opposing, fixed wall means within the chamber, the wall means being disposed to be opposite limits to movement of the projection in the direction of array movement.

* * * * *